US006550111B1

(12) United States Patent
Garraffa, Jr.

(10) Patent No.: US 6,550,111 B1
(45) Date of Patent: Apr. 22, 2003

(54) SLIDE FASTENER SYSTEM

(76) Inventor: Joseph A. Garraffa, Jr., 328 Lakeland Ave., Apt. 1-B, Sayville, NY (US) 11782

( * ) Notice: Subject to any disclaimer, the term of this patent is extended or adjusted under 35 U.S.C. 154(b) by 0 days.

(21) Appl. No.: 09/928,093

(22) Filed: Aug. 10, 2001

(51) Int. Cl.[7] ..... A44B 19/26

(52) U.S. Cl. ..... 24/399; 24/411; 24/419; 24/429; 24/585.1

(58) Field of Search ..... 24/399, 400, 403, 24/406, 411, 412, 419, 426, 417, 420, 429, 437, 585.1, 585.12; 383/63

(56) References Cited

U.S. PATENT DOCUMENTS

| | | | | | |
|---|---|---|---|---|---|
| 2,549,380 | A | * | 4/1951 | Marinsky | 24/411 |
| 2,681,490 | A | * | 6/1954 | Okolowicz | 24/429 |
| 2,736,079 | A | * | 2/1956 | Staller et al. | 24/399 |
| 2,777,181 | A | * | 1/1957 | Morner | 24/399 |
| 2,865,075 | A | * | 12/1958 | Firing et al. | 24/429 |
| 3,234,614 | A | | 2/1966 | Plummer | |
| 3,574,247 | A | * | 4/1971 | Jakob | 24/399 |
| 4,199,845 | A | | 4/1980 | Ausnit | |
| 4,262,395 | A | | 4/1981 | Kosky | |
| 4,455,722 | A | | 6/1984 | Oda | |
| D342,466 | S | | 12/1993 | Tominaga et al. | |
| 5,636,415 | A | | 6/1997 | James | |
| 6,167,597 | B1 | * | 1/2001 | Malin | 24/585.1 |

* cited by examiner

*Primary Examiner*—Victor Sakran

(57) ABSTRACT

A slide fastener assembly includes a first coupling member that has a plurality of locking tabs. A second coupling member has a plurality of locking channels. Each of the locking channels of the second coupling member receives one of the locking tabs of the first coupling member when the second coupling member and the first coupling member are pressed together. A slider assembly is slidably coupled to the first coupling member and the second coupling member. The slider slides in a first direction along the first coupling member and the second coupling member for locking each of the locking tabs of the first coupling member into a respective one of the locking channels of the second coupling member. The slider slides in a second direction for removing each of the locking tabs of the first coupling member from the respective one of the locking channels of the second coupling member.

19 Claims, 7 Drawing Sheets

SLIDE FASTENER SYSTEM

BACKGROUND OF THE INVENTION

1. Field of the Invention

The present invention relates to fastener systems and more particularly pertains to a new slide fastener system for allowing a user to easily zip and seal a garment keeping out wind and water without binding.

2. Description of the Prior Art

The use of fastener systems is known in the prior art. More specifically, fastener systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,636,415; U.S. Pat. No. 3,234,614; U.S. Pat. No. 4,199,845; U.S. Pat. No. 4,262,395; U.S. Pat. No. 4,455,722; U.S. Pat. No. Des. 342,466.

While these devices fulfill their respective, particular objectives and requirements, the aforementioned patents do not disclose a new slide fastener system. The inventive device includes a first coupling member that has a plurality of locking tabs. Each of the locking tabs extends along a length of the first coupling member. The first coupling member is adapted to be coupled to the first panel. A second coupling member has a plurality of locking channels. Each of the locking channels extends along a length of the second coupling member. The second coupling member is adapted to be coupled to the second panel. Each of the locking channels of the second coupling member receives one of the locking tabs of the first coupling member when the second coupling member and the first coupling member are pressed together. The second coupling member and the first coupling member are adapted for joining the first panel to the second panel when the second coupling member and the first coupling member are pressed together. A slider assembly is slidably coupled to the first coupling member and the second coupling member. The slider slides in a first direction along the first coupling member and the second coupling member for locking each of the locking tabs of the first coupling member into a respective one of the locking channels of the second coupling member. The slider slides in a second direction along the first coupling member and the second coupling member for removing each of the locking tabs of the first coupling member from the respective one of the locking channels of the second coupling member.

In these respects, the slide fastener system according to the present invention substantially departs from the conventional concepts and designs of the prior art, and in so doing provides an apparatus primarily developed for the purpose of allowing a user to easily zip and seal a garment keeping out wind and water without binding.

SUMMARY OF THE INVENTION

In view of the foregoing disadvantages inherent in the known types of fastener systems now present in the prior art, the present invention provides a new slide fastener system construction wherein the same can be utilized for allowing a user to easily zip and seal a garment keeping out wind and water without binding.

The general purpose of the present invention, which will be described subsequently in greater detail, is to provide a new slide fastener system apparatus and method which has many of the advantages of the fastener systems mentioned heretofore and many novel features that result in a new slide fastener system which is not anticipated, rendered obvious, suggested, or even implied by any of the prior art fastener systems, either alone or in any combination thereof.

To attain this, the present invention generally comprises a first coupling member that has a plurality of locking tabs. Each of the locking tabs extends along a length of the first coupling member. The first coupling member is adapted to be coupled to the first panel. A second coupling member has a plurality of locking channels. Each of the locking channels extends along a length of the second coupling member. The second coupling member is adapted to be coupled to the second panel. Each of the locking channels of the second coupling member receives one of the locking tabs of the first coupling member when the second coupling member and the first coupling member are pressed together. The second coupling member and the first coupling member are adapted for joining the first panel to the second panel when the second coupling member and the first coupling member are pressed together. A slider assembly is slidably coupled to the first coupling member and the second coupling member. The slider slides in a first direction along the first coupling member and the second coupling member for locking each of the locking tabs of the first coupling member into a respective one of the locking channels of the second coupling member. The slider slides in a second direction along the first coupling member and the second coupling member for removing each of the locking tabs of the first coupling member from the respective one of the locking channels of the second coupling member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new slide fastener system apparatus and method which has many of the advantages of the fastener systems mentioned heretofore and many novel features that result in a new slide fastener system which is not anticipated, rendered obvious, suggested, or even implied by any of the prior art fastener systems, either alone or in any combination thereof.

It is another object of the present invention to provide a new slide fastener system, which may be easily and efficiently manufactured and marketed.

It is a further object of the present invention to provide a new slide fastener system, which is of a durable and reliable construction.

An even further object of the present invention is to provide a new slide fastener system which is susceptible of a low cost of manufacture with regard to both materials and labor, and which accordingly is then susceptible of low prices of sale to the consuming public, thereby making such slide fastener system economically available to the buying public.

Still yet another object of the present invention is to provide a new slide fastener system, which provides in the apparatuses and methods of the prior art some of the advantages thereof, while simultaneously overcoming some of the disadvantages normally associated therewith.

Still another object of the present invention is to provide a new slide fastener system for allowing a user to easily zip and seal a garment keeping out wind and water without binding.

Yet another object of the present invention is to provide a new slide fastener system, which includes a first coupling member that has a plurality of locking tabs. Each of the locking tabs extends along a length of the first coupling member. The first coupling member is adapted to be coupled to the first panel. A second coupling member has a plurality of locking channels. Each of the locking channels extends along a length of the second coupling member. The second coupling member is adapted to be coupled to the second panel. Each of the locking channels of the second coupling member receives one of the locking tabs of the first coupling member when the second coupling member and the first coupling member are pressed together. The second coupling member and the first coupling member are adapted for joining the first panel to the second panel when the second coupling member and the first coupling member are pressed together. A slider assembly is slidably coupled to the first coupling member and the second coupling member. The slider slides in a first direction along the first coupling member and the second coupling member for locking each of the locking tabs of the first coupling member into a respective one of the locking channels of the second coupling member. The slider slides in a second direction along the first coupling member and the second coupling member for removing each of the locking tabs of the first coupling member from the respective one of the locking channels of the second coupling member.

Still yet another object of the present invention is to provide a new slide fastener system that would provide a high level of reliability being resistant to binding, tearing, corroding, or falling apart due to teeth breaking, therefore keeping moisture and breezes out of various marine type applications.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
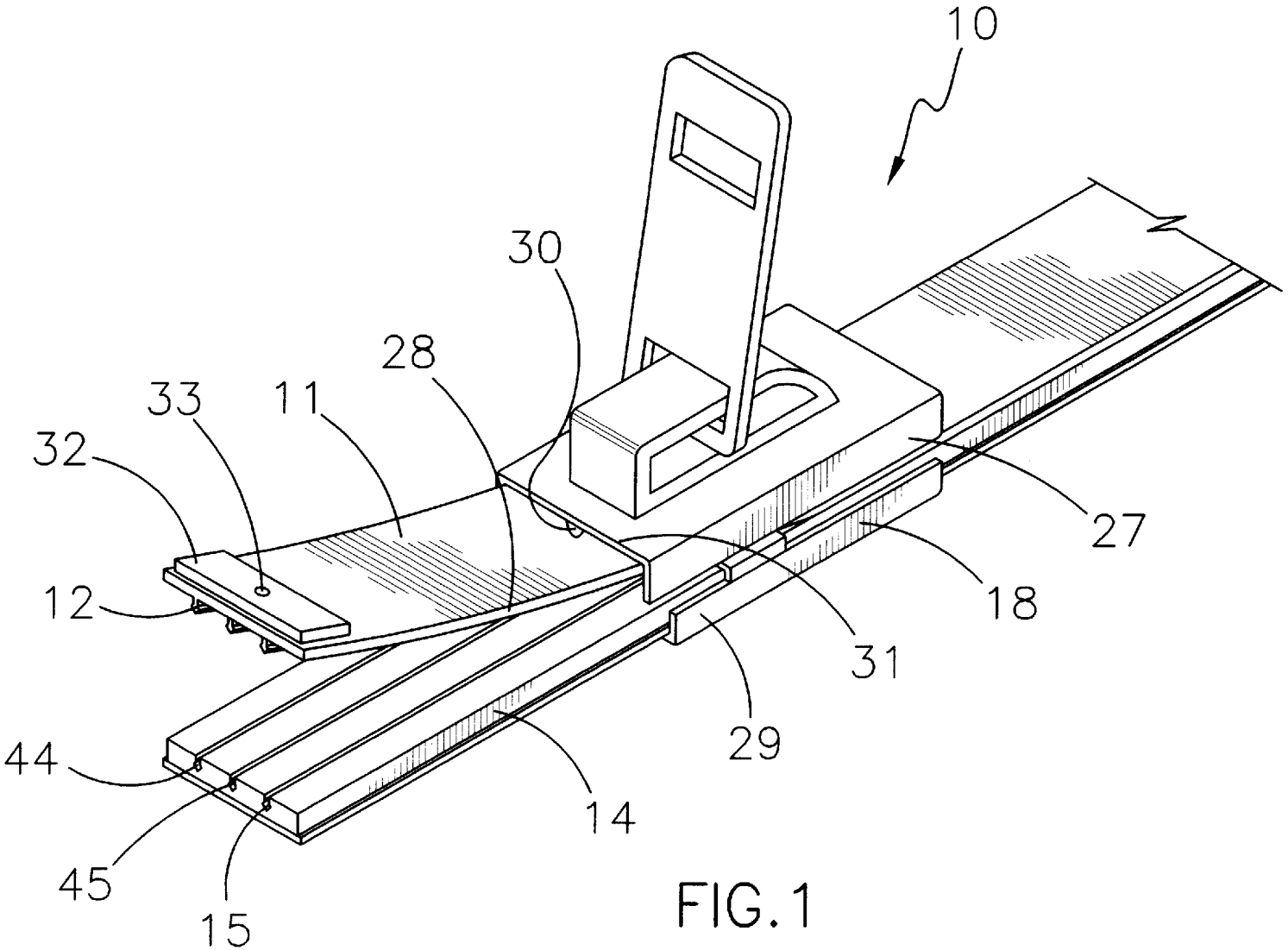
FIG. 1 is a perspective view of a new slide fastener system according to the present invention.
Figure 2:
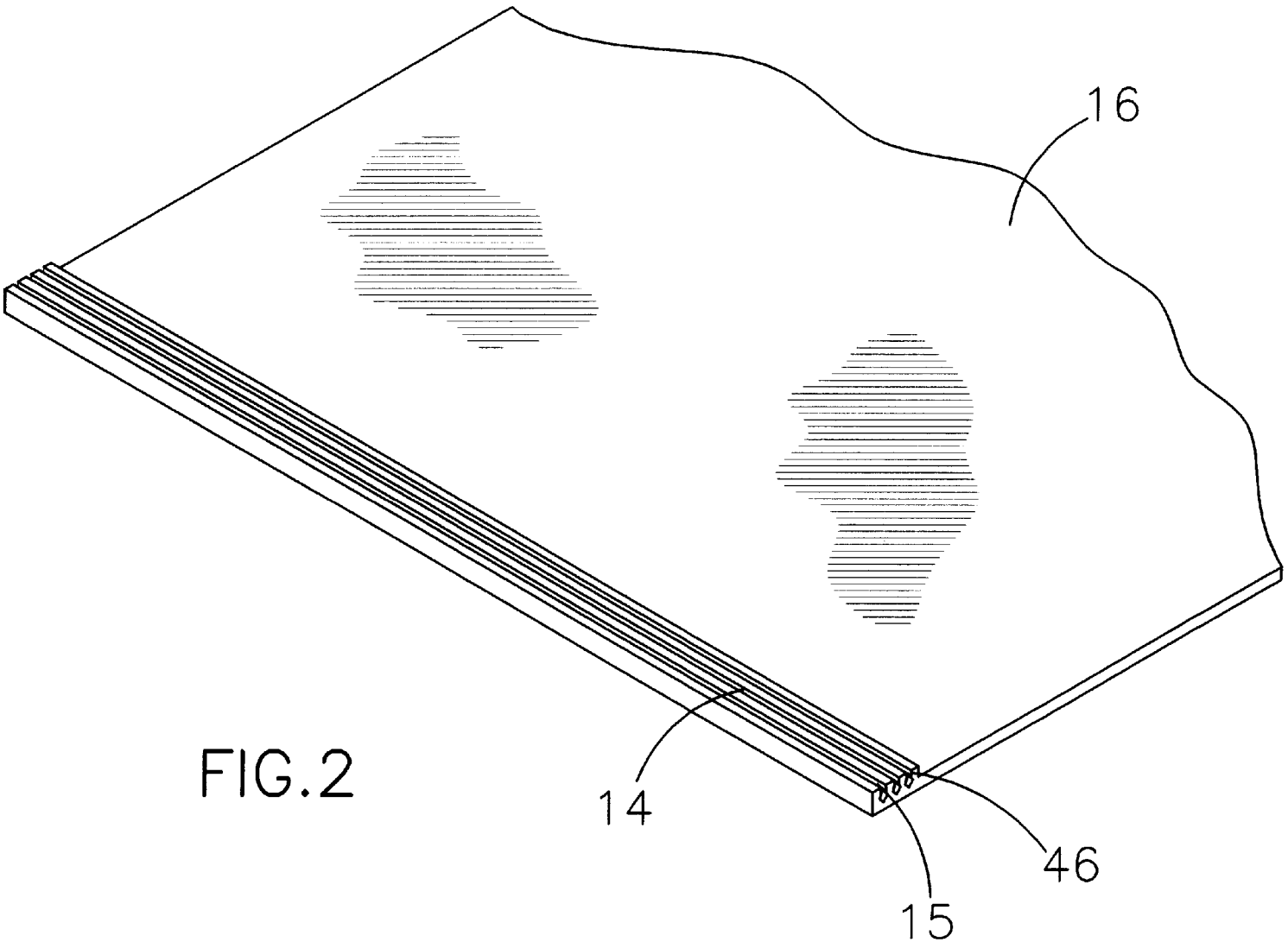
FIG. 2 is a perspective view of the present invention.
Figure 3:
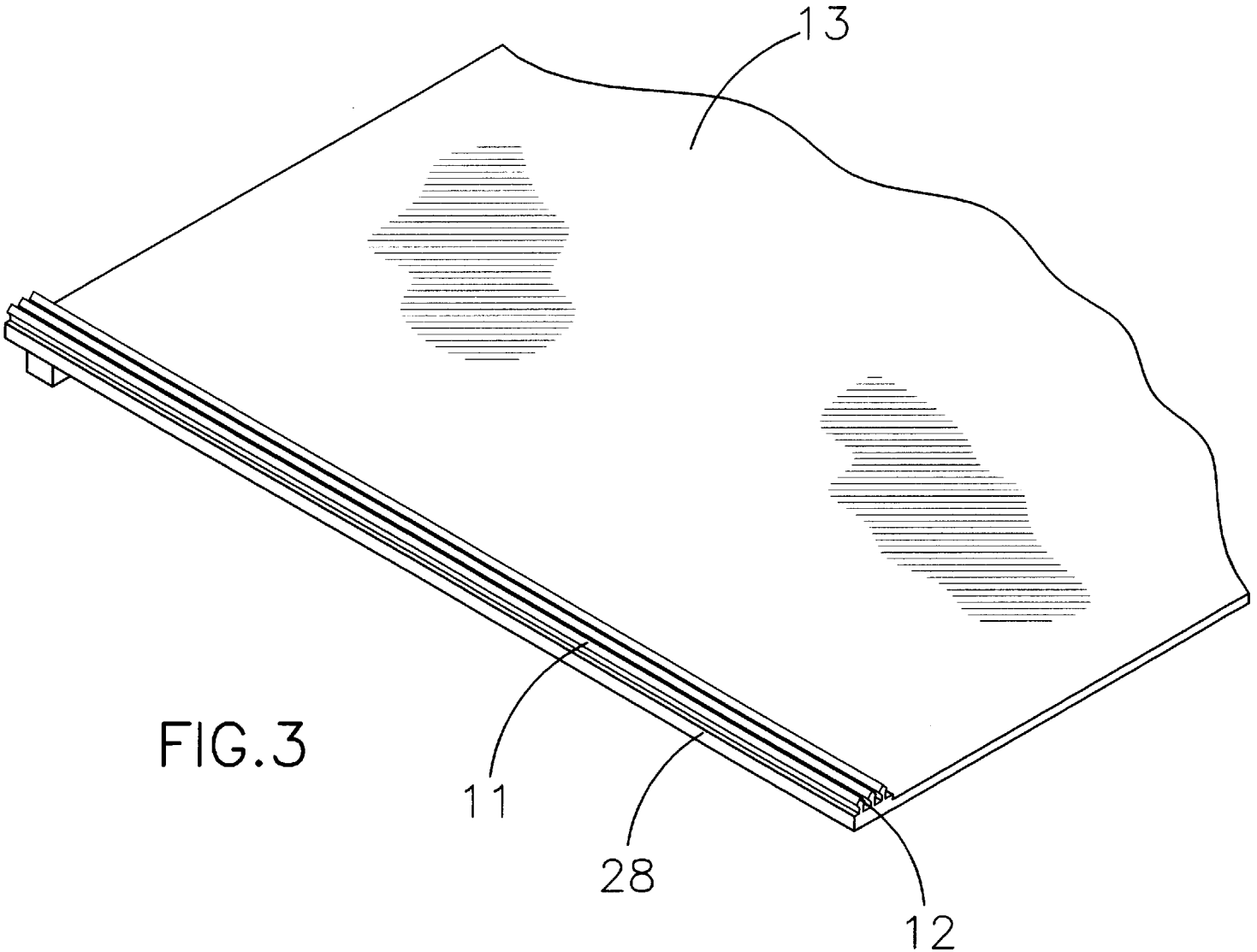
FIG. 3 is a perspective view of the present invention.
Figure 4:
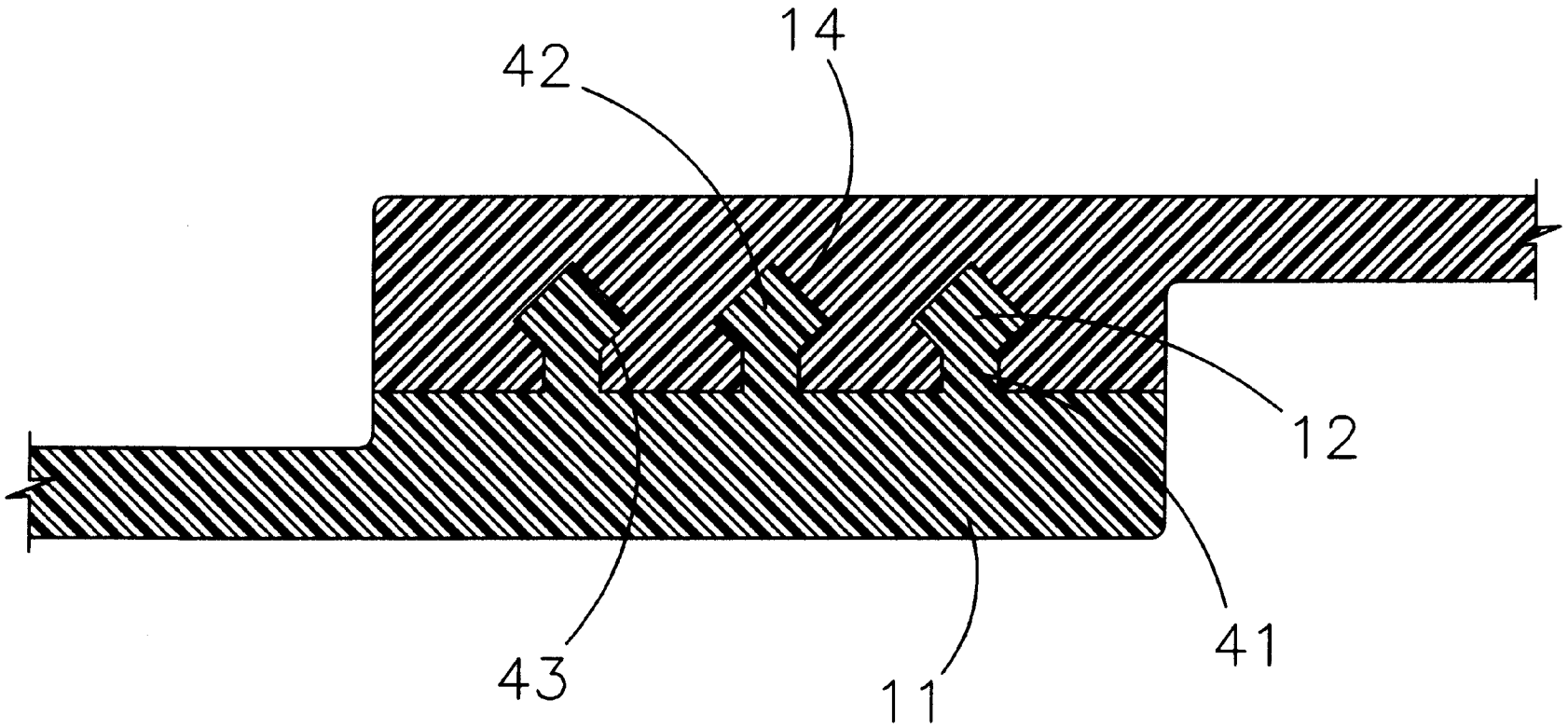
FIG. 4 is a cross-sectional view of the present invention.
Figure 5:
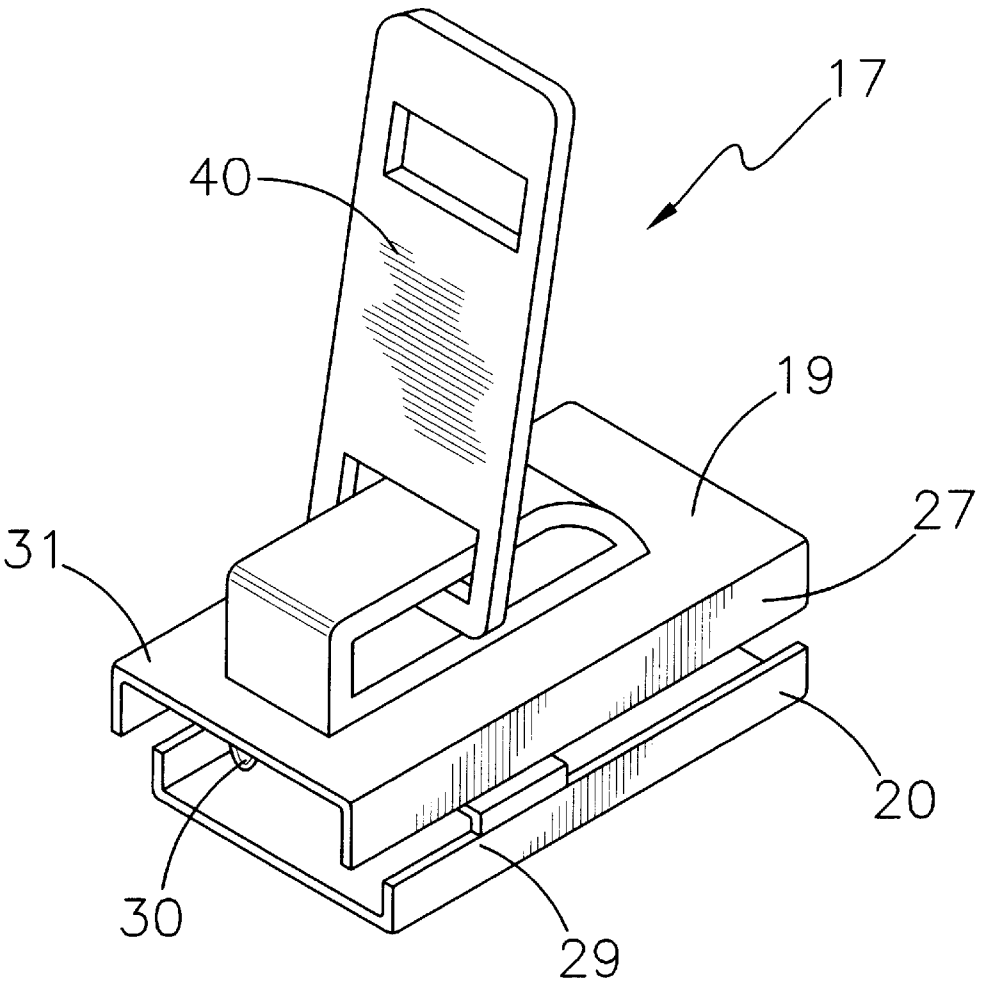
FIG. 5 is a perspective view of the present invention.
Figure 6:
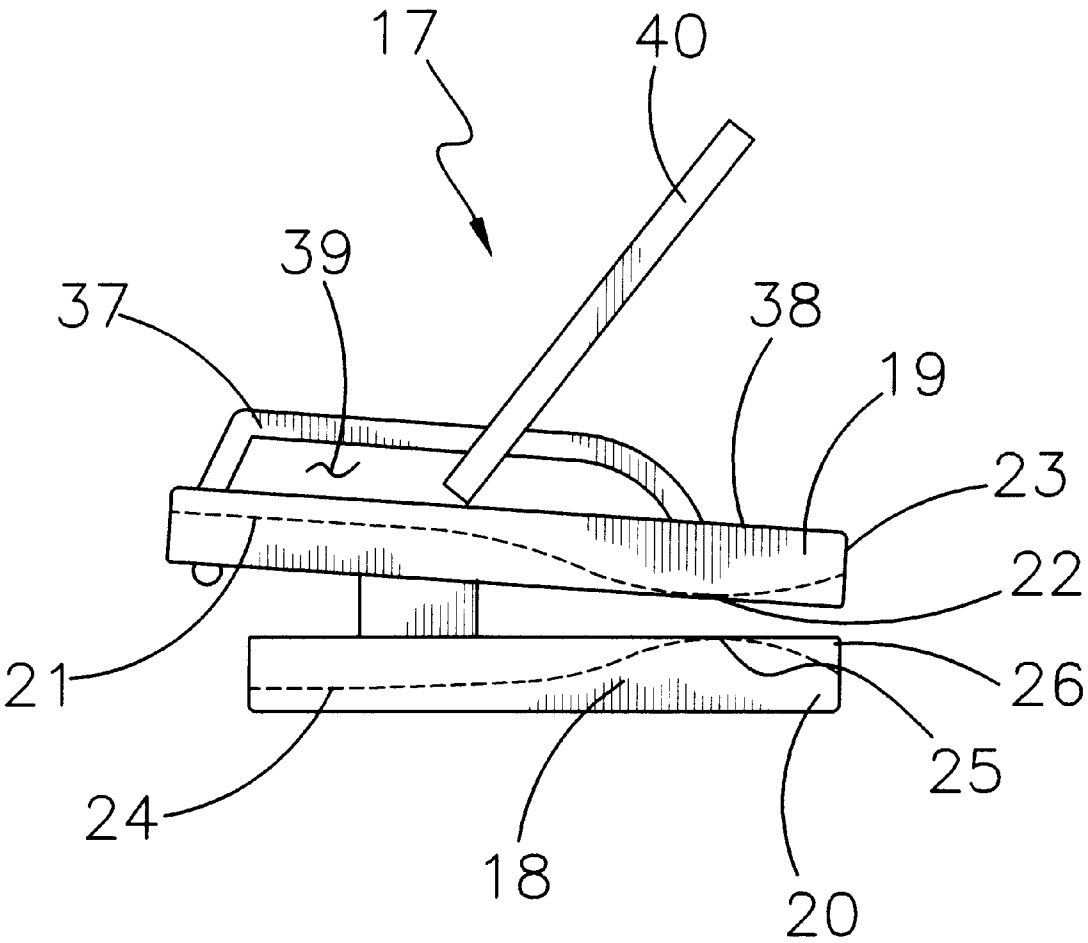
FIG. 6 is a side view of the present invention.
Figure 7:
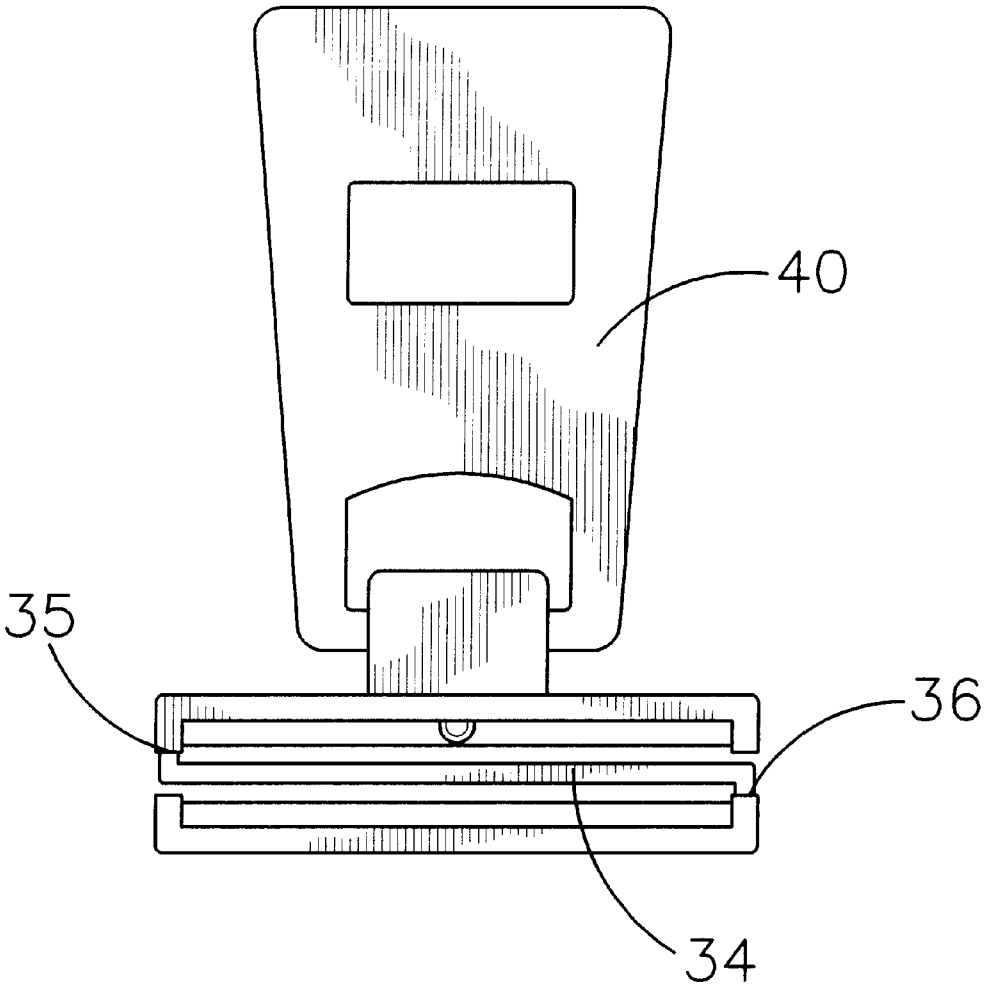
FIG. 7 is a front view of the present invention.

With reference now to the drawings, and in particular to FIGS. 1 through 7 thereof, a new slide fastener system embodying the principles and concepts of the present invention and generally designated by the reference numeral 10 will be described.

As best illustrated in FIGS. 1 through 7, slide fastener system 10 generally includes a first coupling member 11 that has a plurality of locking tabs 12. Each of the locking tabs 12 extends along a length of the first coupling member 11. The first coupling member 11 is adapted to be coupled to the first panel 13. A second coupling member 14 has a plurality of locking channels 15. Each of the locking channels 15 extends along a length of the second coupling member 14. The second coupling member 14 is adapted to be coupled to the second panel 16. Each of the locking channels 15 of the second coupling member 14 receives one of the locking tabs 12 of the first coupling member 11 when the second coupling member 14 and the first coupling member 11 are pressed together. The second coupling member 14 and the first coupling member 11 are adapted for joining the first panel 13 to the second panel 16 when the second coupling member 14 and the first coupling member 11 are pressed together. A slider assembly 17 is slidably coupled to the first coupling member 11 and the second coupling member 14. The slider 18 slides in a first direction along the first coupling member 11 and the second coupling member 14 for locking each of the locking tabs 12 of the first coupling member 11 into a respective one of the locking channels 15 of the second coupling member 14. The slider 18 slides in a second direction along the first coupling member 11 and the second coupling member 14 for removing each of the locking tabs 12 of the first coupling member 11 from the respective one of the locking channels 15 of the second coupling member 14.

The slider assembly 17 has a first portion 19 and a second portion 20. The first portion 19 of the slider assembly 17 receives the first coupling member 11 and the second portion 20 of the slider assembly 17 receives the second coupling member 14 when the slider assembly 17 is coupled to the first coupling member 11 and the second coupling member 14. The first portion 19 and the second portion 20 of the slider assembly 17 are for pressing the locking tabs 12 of the first coupling member 11 into the locking channels 15 of the second coupling member 14 when the slider assembly 17 is slid in the first direction.

The first portion 19 of the slider assembly 17 has a flat portion 21. A convex portion 22 is integrally coupled to the flat portion 21. The convex portion 22 is positioned proximate a rear end 23 of the first portion 19 of the slider assembly 17. The convex portion 22 is for compressing the first coupling member 11 against the second coupling member 14 such that the locking tabs 12 of the first coupling member 11 engage the locking channels 15 of the second coupling member 14 when the slider assembly 17 is slid in a first direction.

The second portion 20 of the slider assembly 17 has a substantially planar portion 24. A protruding portion 25 is integrally coupled to the planar portion 24. The protruding portion 25 is positioned proximate a back end 26 of the second portion 20 of the slider assembly 17. The protruding portion 25 is aligned with the convex portion 22 of the first portion 19 such that the first coupling member 11 and the second coupling member 14 are compressed between the convex portion 22 of the first coupling member 11 and the protruding portion 25 of the second coupling member 14 for engaging the locking tabs 12 of the first coupling member 11 to the locking channels 15 of the second coupling member 14 when the slider assembly 17 is slid in a first direction.

The first portion 19 of the slider assembly 17 has a pair of sidewalls 27. Each of the sidewalls 27 engages one of a pair of side faces 28 of the first coupling member 11 such that that sidewalls 27 are for keeping the first portion 19 of the slider assembly 17 aligned with the first coupling member 11. The second portion 20 of the slider assembly 17 has a pair of edge walls 29. Each of the edge walls 29 engages one of a pair of edge walls 29 of the second coupling member 14 such that the edge walls 29 are for keeping the second portion 20 of the slider assembly 17 aligned with the second coupling member 14. The first portion 19 of the slider assembly 17 has a securing nub 30. The securing nub 30 is coupled to a front end 31 of the first portion 19 of the slider assembly 17.

The first coupling member 11 has a securing block 32. The securing block 32 is coupled to an outer surface of the first coupling member 11. A securing aperture 33 extends through the securing block 32. The securing aperture 33 selectively receives the securing nub 30 of the first portion of the slider assembly 17 for preventing inadvertent sliding of the slider assembly 17 with respect to the first coupling member 11 when the slider assembly 17 is slid along the length of the first coupling member 11 and the second coupling member 14 in the first direction.

The slider assembly 17 has a separation member 34. The separation member 34 is coupled between the first portion 19 of the slider assembly 17 and the second portion 20 of the slider assembly 17. The first portion 19 of the slider assembly 17 is coupled to a first end 35 of the separation member 34 such that the first coupling member 11 is positioned between the separation member 34 and the first portion 19 of the slider assembly 17. The second portion 20 of the slider assembly 17 is coupled to a second end 36 of the separation member 34 such that the second coupling member 14 is positioned between the separation member 34 and the second portion 20 of the slider 18, the separation member 34 is for forcing the first coupling member 11 from the second coupling member 14 when the slider assembly 17 is slid in the second direction. The first portion 19 of the slider assembly 17 has a raised portion 37. The raised portion 37 is coupled to a top wall 38 of the first portion 19 of the slider assembly 17. The raised portion 37 has a slot 39 that extends through the raised portion 37.

The slider assembly 17 has a tab member 40. The tab member 40 is extends through the slot 39 in the raised portion 37 of the first portion 19 of the slider assembly 17. A hand of the user grips the tab member 40 such that the tab member 40 is adapted for facilitating sliding of the slider assembly 17.

Each of the locking tabs 12 of the first coupling member 11 has base portion 41 and a head portion 42. The base portion 41 of each of the locking tabs 12 is coupled to an inner face 43 of the first coupling member 11. The head portion 42 of each of the locking tabs 12 is positioned at an end of the base portion 41 opposite the inner face 43 of the first coupling member 11.

Each of the locking channels 15 has a receiving portion 44 and securing portion 45. The receiving portion 44 of each of the locking channels 15 inwardly extends from an interior face 46 of the second coupling member 14. The securing portion 45 of each of the locking channels 15 is positioned opposite the interior face 46 of the second coupling member 14. The securing portion 45 of each of the locking channels 15 is for selectively securing the head portion 42 of an associated one of the locking tabs 12 when the first coupling member 11 and the second coupling member 14 are pressed together by the slider assembly 17.

In use, a user would use the present invention much like a conventional zipper. One advantage of the present invention over conventional zipper would be that it seals two pieces of material by overlapping.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A slide fastener system for joining a first panel to second panel by a user, the slide fastener system comprising:

a first coupling member having a plurality of locking tabs, each of said locking tabs extending along a length of said first coupling member, said first coupling member being adapted for being coupled to the first panel;

a second coupling member having a plurality of locking channels, each of said locking channels extending along a length of said second coupling member, said second coupling member being adapted for being coupled to the second panel, each of said locking channels of said second coupling member receiving one of said locking tabs of said first coupling member when said second coupling member and said first coupling member are pressed together, said second coupling member and said first coupling member being adapted for joining the first panel to the second panel when said second coupling member and said first coupling member are pressed together;

a slider assembly being slidably coupled to said first coupling member and said second coupling member, said slider sliding in a first direction along said first coupling member and said second coupling member for locking each of said locking tabs of said first coupling member into a respective one of said locking channels of said second coupling member, said slider sliding in a second direction along said first coupling member and said second coupling member for removing each of said locking tabs of said first coupling member from the respective one of said locking channels of said second coupling member;

said slider assembly having a first portion and a second portion, said first portion of said slider assembly receiving said first coupling member and said second portion of said slider assembly receiving said second coupling member when said slider assembly is coupled to said first coupling member and said second coupling member, said first portion and said second portion of said slider assembly being for pressing said locking tabs of said first coupling member into said locking channels of said second coupling member when said slider assembly is slid in said first direction;

said first portion of said slider assembly having a flat portion, a convex portion being integrally coupled to said flat portion, said convex portion being positioned proximate an rear end of the first portion of said slider assembly, said convex portion being for compressing said first coupling member against said second coupling member such that said locking tabs of said first coupling member engage said locking channels of said second coupling member when said slider assembly is slid in a first direction; and said second portion of said slider assembly having a substantially planar portion, a protruding portion being integrally coupled to said planar portion, said protruding portion being positioned proximate an back end of the second portion of said slider assembly, said protruding portion being aligned with said convex portion of said first portion such that said first coupling member and said second coupling member are compressed between said convex portion of said first coupling member and said protruding portion of said second coupling member for engaging said locking tabs of said first coupling member to said locking channels of said second coupling member when said slider assembly is slid in a first direction.

2. The slide fastener system as set forth in claim 1, further comprising:

said first portion of said slider assembly having a pair of side walls, each of said side walls engaging one of a pair of side faces of said first coupling member such that that side walls are for keeping said first portion of said slider assembly aligned with said first coupling member.

3. The slide fastener system as set forth in claim 1, further comprising:

said second portion of said slider assembly having a pair of edge walls, each of said edge walls engaging one of a pair of edge walls of said second coupling portion such that said edge walls are for keeping said second portion of said slider assembly aligned with said second coupling member.

4. The slide fastener system as set forth in claim 1, further comprising:

said first portion of said slider assembly having a securing nub, said securing nub being coupled to a front end of said first portion of the slider assembly;

said first coupling member having a securing block, said securing block being coupled to an outer surface of said first coupling member, a securing aperture extending through said securing block, said securing aperture selectively receiving said securing nub of said first portion of said slider assembly for preventing inadvertent sliding of said slider assembly with respect to said first coupling member when said slider assembly is slid along the length of the said first coupling member and said second coupling member in said first direction.

5. The slide fastener system as set forth in claim 1, further comprising:

said slider assembly having a separation member, said separation member being coupled between said first portion of said slider assembly and said second portion of said slider assembly, said first portion of said slider assembly being coupled to a first end of said separation member such that said first coupling member is positioned between said separation member and said first portion of said slider assembly, said second portion of said slider assembly being coupled to a second end of said separation member such that said second coupling member is positioned between said separation member and said second portion of said sliding member, said separation member being for forcing said first coupling member from said second coupling member when said slider assembly is slid in said second direction.

6. The slide fastener system as set forth in claim 1, further comprising:

said first portion of said slider assembly having a raised portion, said raised portion being coupled to a top wall of said first portion of said slider assembly, said raised portion having a slot extending through said raised portion;

said slider assembly having a tab member, said tab member being extending through said slot in said raised portion of said first portion of said slider assembly, said tab member being adapted for being gripped by a hand of the user such that said tab member is adapted for facilitating sliding of said slider assembly.

7. The slide fastener system as set forth in claim 1, further comprising:

each of said locking tabs of said first coupling member having base portion and a head portion, said base portion of each of said locking tabs being coupled to a inner face of said first coupling member, said head portion of each of said locking tabs being positioned at an end of said base portion opposite said inner face of said first coupling member; and each of said locking channels of said having a receiving portion and securing portion, said receiving portion of each of said locking channels inwardly extending from an interior face of said second coupling member, said securing portion of each of said locking channels being positioned opposite said interior face of said second coupling member, said securing portion of each of said locking channels being for selectively securing said head portion of an associated one of said locking tabs when said first coupling member and said second coupling member are pressed together by said slider assembly.

8. The slide fastener system as set forth in claim 1, further comprising:

wherein said first portion of said slider assembly having a pair of side walls, each of said side walls engaging one of a pair of side faces of said first coupling member such that that side walls are for keeping said first portion of said slider assembly aligned with said first coupling member;

wherein said second portion of said slider assembly having a pair of edge walls, each of said edge walls engaging one of a pair of edge walls of said second coupling portion such that said edge walls are for keeping said second portion of said slider assembly aligned with said second coupling member;

wherein said first portion of said slider assembly having a securing nub, said securing nub being coupled to a front end of said first portion of the slider assembly;

said first coupling member having a securing block, said securing block being coupled to an outer surface of said first coupling member, a securing aperture extending through said securing block, said securing aperture selectively receiving said securing nub of said first portion of said slider assembly for preventing inadvertent sliding of said slider assembly with respect to said first coupling member when said slider assembly is slid along the length of the said first coupling member and said second coupling member in said first direction;

wherein said slider assembly having a separation member, said separation member being coupled between said first portion of said slider, assembly and said second portion of said slider assembly, said first portion of said slider assembly being coupled to a first end of said separation member such that said first coupling member is positioned between said separation member and said first portion of said slider assembly, said second portion of said slider assembly being coupled to a second end of said separation member such that said second coupling member is positioned between said separation member and said second portion of said sliding member, said separation member being for forcing said first coupling member from said second coupling member when said slider assembly is slid in said second direction;

wherein said first portion of said slider assembly having a raised portion, said raised portion being coupled to a top wall of said first portion of said slider assembly, said raised portion having a slot extending through said raised portion;

said slider assembly having a tab member, said tab member being extending through said slot in said raised portion of said first portion of said slider assembly, said tab member being adapted for being gripped by a hand of the user such that said tab member is adapted for facilitating sliding of said slider assembly;

wherein each of said locking tabs of said first coupling member having base portion and a head portion, said base portion of each of said locking tabs being coupled to a inner face of said first coupling member, said head portion of each of said locking tabs being positioned at an end of said base portion opposite said inner face of said first coupling member; and each of said locking channels of said having a receiving portion and securing portion, said receiving portion of each of said locking channels inwardly extending from an interior face of said second coupling member, said securing portion of each of said locking channels being positioned opposite said interior face of said second coupling member, said securing portion of each of said locking channels being for selectively securing said head portion of an associated one of said locking tabs when said first coupling member and said second coupling member are pressed together by said slider assembly.

9. A slide fastener system for joining a first panel to second panel by a user, the slide fastener system comprising:

a first coupling member having a plurality of locking tabs, each of said locking tabs extending along a length of said first coupling member, said first coupling member being adapted for being coupled to the first panel;

a second coupling member having a plurality of locking channels, each of said locking channels extending along a length of said second coupling member, said second coupling member being adapted for being coupled to the second panel, each of said locking channels of said second coupling member receiving one of said locking tabs of said first coupling member when said second coupling member and said first coupling member are pressed together, said second coupling member and said first coupling member being adapted for joining the first panel to the second panel when said second coupling member and said first coupling member are pressed together;

a slider assembly being slidably coupled to said first coupling member and said second coupling member, said slider sliding in a first direction along said first coupling member and said second coupling member for locking each of said locking tabs of said first coupling member into a respective one of said locking channels of said second coupling member, said slider sliding in a second direction along said first coupling member and said second coupling member for removing each of said locking tabs of said first coupling member from the respective one of said locking channels of said second coupling member;

said slider assembly having a first portion and a second portion, said first portion of said slider assembly receiving said first coupling member and said second portion of said slider assembly receiving said second coupling member when said slider assembly is coupled to said first coupling member and said second coupling member, said first portion and said second portion of said slider assembly being for pressing said locking tabs of said first coupling member into said locking channels of said second coupling member when said slider assembly is slid in said first direction;

said first portion of said slider assembly having a securing nub, said securing nub being coupled to a front end of said first portion of the slider assembly; and said first coupling member having a securing block, said securing block being coupled to an outer surface of said first coupling member, a securing aperture extending through said securing block, said securing aperture selectively receiving said securing nub of said first portion of said slider assembly for preventing inadvertent sliding of said slider assembly with respect to said first coupling member when said slider assembly is slid along the length of the said first coupling member and said second coupling member in said first direction.

10. The slide fastener system as set forth in claim 9, further comprising:

said first portion of said slider assembly having a pair of side walls, each of said side walls engaging one of a pair of side faces of said first coupling member such that that side walls are for keeping said first portion of said slider assembly aligned with said first coupling member.

11. The slide fastener system as set forth in claim 10, further comprising:

said second portion of said slider assembly having a pair of edge walls, each of said edge walls engaging one of a pair of edge walls of said second coupling portion such that said edge walls are for keeping said second portion of said slider assembly aligned with said second coupling member.

12. The slide fastener system as set forth in claim 9, further comprising:

said slider assembly having a separation member, said separation member being coupled between said first portion of said slider assembly and said second portion of said slider assembly, said first portion of said slider assembly being coupled to a first end of said separation member such that said first coupling member is positioned between said separation member and said first portion of said slider assembly, said second portion of said slider assembly being coupled to a second end of said separation member such that said second coupling member is positioned between said separation member and said second portion of said sliding member, said separation member being for forcing said first coupling member from said second coupling member when said slider assembly is slid in said second direction.

13. The slide fastener system as set forth in claim 9, further comprising:

said first portion of said slider assembly having a raised portion, said raised portion being coupled to a top wall of said first portion of said slider assembly, said raised portion having a slot extending through said raised portion;

said slider assembly having a tab member, said tab member being extending through said slot in said raised portion of said first portion of said slider assembly, said tab member being adapted for being gripped by a hand of the user such that said tab member is adapted for facilitating sliding of said slider assembly.

14. The slide fastener system as set forth in claim 9, further comprising:

each of said locking tabs of said first coupling member having base portion and a head portion, said base portion of each of said locking tabs being coupled to a inner face of said first coupling member, said head portion of each of said locking tabs being positioned at an end of said base portion opposite said inner face of said first coupling member; and each of said locking channels of said having a receiving portion and securing portion, said receiving portion of each of said locking channels inwardly extending from an interior face of said second coupling member, said securing portion of each of said locking channels being positioned opposite said interior face of said second coupling member, said securing portion of each of said locking channels being for selectively securing said head portion of an associated one of said locking tabs when said first coupling member and said second coupling member are pressed together by said slider assembly.

15. A slide fastener system for joining a first panel to second panel by a user, the slide fastener system comprising:

a first coupling member having a plurality of locking tabs, each of said locking tabs extending along a length of said first coupling member, said first coupling member being adapted for being coupled to the first panel;

a second coupling member having a plurality of locking channels, each of said locking channels extending along a length of said second coupling member, said second coupling member being adapted for being coupled to the second panel, each of said locking channels of said second coupling member receiving one of said locking tabs of said first coupling member when said second coupling member and said first coupling member are pressed together, said second coupling member and said first coupling member being adapted for joining the first panel to the second panel when said second coupling member and said first coupling member are pressed together;

a slider assembly being slidably coupled to said first coupling member and said second coupling member, said slider sliding in a first direction along said first coupling member and said second coupling member for locking each of said locking tabs of said first coupling member into a respective one of said locking channels of said second coupling member, said slider sliding in a second direction along said first coupling member and said second coupling member for removing each of said locking tabs of said first coupling member from the respective one of said locking channels of said second coupling member;

said slider assembly having a first portion and a second portion, said first portion of said slider assembly receiving said first coupling member and said second portion of said slider assembly receiving said second coupling member when said slider assembly is coupled to said first coupling member and said second coupling member, said first portion and said second portion of said slider assembly being for pressing said locking tabs of said first coupling member into said locking channels of said second coupling member when said slider assembly is slid in said first direction; and said slider assembly having a separation member, said separation member being coupled between said first portion of said slider assembly and said second portion of said slider assembly, said first portion of said slider assembly being coupled to a first end of said separation member such that said first coupling member is positioned between said separation member and said first portion of said slider assembly, said second portion of said slider assembly being coupled to a second end of said separation member such that said second coupling member is positioned between said separation member and said second portion of said sliding member, said separation member being for forcing said first coupling member from said second coupling member when said slider assembly is slid in said second direction.

16. The slide fastener system as set forth in claim 15, further comprising:

said first portion of said slider assembly having a pair of side walls, each of said side walls engaging one of a pair of side faces of said first coupling member such that that side walls are for keeping said first portion of said slider assembly aligned with said first coupling member.

17. The slide fastener system as set forth in claim 15, further comprising:

said second portion of said slider assembly having a pair of edge walls, each of said edge walls engaging one of a pair of edge walls of said second coupling portion such that said edge walls are for keeping said second portion of said slider assembly aligned with said second coupling member.

18. The slide fastener system as set forth in claim 15, further comprising:

said first portion of said slider assembly having a raised portion, said raised portion being coupled to a top wall of said first portion of said slider assembly, said raised portion having a slot extending through said raised portion;

said slider assembly having a tab member, said tab member being extending through said slot in said raised portion of said first portion of said slider assembly, said tab member being adapted for being gripped by a hand of the user such that said tab member is adapted for facilitating sliding of said slider assembly.

19. The slide fastener system as set forth in claim 15, further comprising:

each of said locking tabs of said first coupling member having base portion and a head portion, said base portion of each of said locking tabs being coupled to a inner face of said first coupling member, said head portion of each of said locking tabs being positioned at an end of said base portion opposite said inner face of said first coupling member; and each of said locking channels of said having a receiving portion and securing portion, said receiving portion of each of said locking channels inwardly extending from an interior face of said second coupling member, said securing portion of each of said locking channels being positioned opposite said interior face of said second coupling member, said securing portion of each of said locking channels being for selectively securing said head portion of an associated one of said locking tabs when said first coupling member and said second coupling member are pressed together by said slider assembly.

* * * * *